United States Patent [19]

Kaufman

[11] Patent Number: 4,548,062

[45] Date of Patent: Oct. 22, 1985

[54] SECURITY DEVICE FOR PREVENTING SEPARATION OF A LOCK FROM A DOOR

[76] Inventor: Lazar Kaufman, 454 Ft. Washington Ave., Apt. #50A, New York, N.Y. 10033

[21] Appl. No.: 433,657

[22] Filed: Oct. 12, 1982

[51] Int. Cl.[4] ..... E05B 63/00

[52] U.S. Cl. ..... 70/417

[58] Field of Search ..... 70/417, 418, 416; 292/346

[56] References Cited

U.S. PATENT DOCUMENTS

| | | | |
|---|---|---|---|
| 3,981,168 | 9/1976 | Coralli | 70/417 |
| 4,041,741 | 8/1977 | Cintron | 70/417 |

FOREIGN PATENT DOCUMENTS

| | | | |
|---|---|---|---|
| 327350 | 10/1920 | Fed. Rep. of Germany | 70/417 |
| 2916501 | 11/1980 | Fed. Rep. of Germany | 70/417 |

*Primary Examiner*—Robert L. Wolfo

*Attorney, Agent, or Firm*—Amster, Rothstein & Engelberg

[57] ABSTRACT

A device is disclosed which is mounted to a door over an independently mounted lock to prevent separation of the lock from the door. In one embodiment, the device comprises an interior plate having a recessed portion and flange portions, which is fastened to the interior of the door by bolts passing through the door with the recessed portion covering the lock. The plate holds the lock against the interior of the door and prevents its separation from the door when forces are applied to the lock from the exterior of the door via the lock cylinder or directly to the lock after the cylinder has been removed. In another embodiment, the device also comprises an exterior plate mounted to the exterior of the door covering the heads of the bolts used to mount the interior plate to the door.

3 Claims, 2 Drawing Figures

SECURITY DEVICE FOR PREVENTING SEPARATION OF A LOCK FROM A DOOR

The present invention relates to a security device which is affixed to a door to prevent a lock independently mounted to the door from being separated from the door from the outside.

SUMMARY OF THE INVENTION

A plate is provided for preventing separation of an independently mounted door lock from the door from the outside. The plate is mounted inside of the door and envelops the lock. A second plate can be provided on the outside of the door and the two plates can be connected together.

DETAILED DESCRIPTION OF THE PREFERRED EMBODIMENTS

Figure 1:
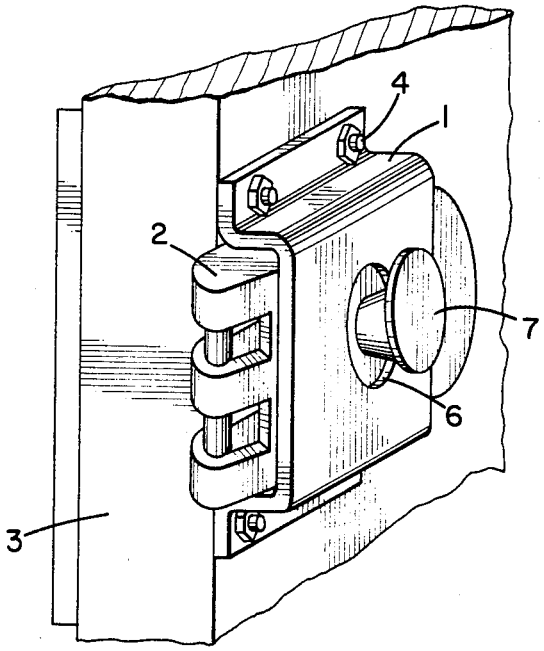
FIG. 1 is a perspective view of a standard lock mounted on the door and enveloped by means the plate according to the invention from inside of the door.
Figure 2:
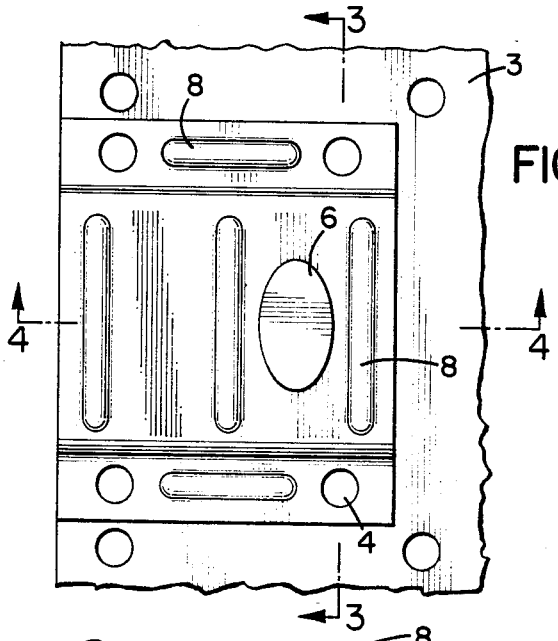
FIG. 2 is a front elevation view of the plate of FIG. 1 including reinforcing ribs, with the plate mounted to the door and with the mounting nuts and lock omitted.
Figure 3:
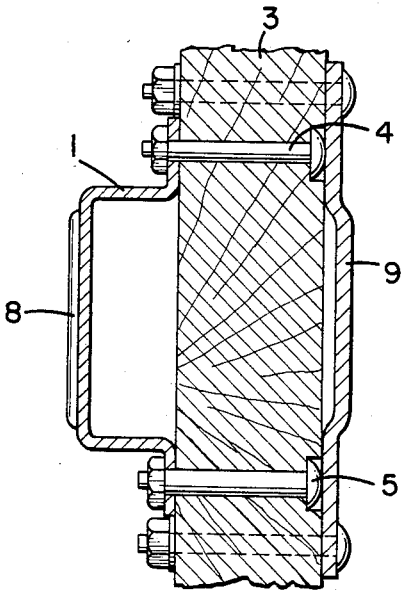
FIG. 3 is a section view taken along line 3—3 of FIG. 2 showing the plate mounted to the door by bolts and a second plate mounted outside of the door by bolts.
Figure 4:
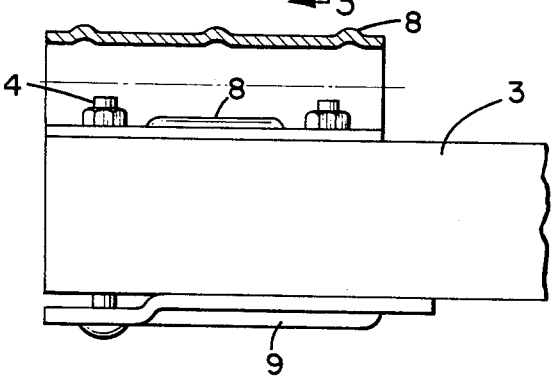
FIG. 4 is a section view taken along lines 4—4 of FIG. 2.

The use of different devices for securing a lock against destruction of its cylinder, has caused in recent times the knocking out of the lock from a door into the apartment. This invention secures the lock against this accurrence. FIGS. 1 and 2 show a plate 1, which envelope the lock 2 and is fixed to the door 3 by means of the bolts 4, which are passed through the door. Said plate is provided with a hole 6, through which passes the head 7 of the lock for manually locking it. The plate 1 is provided with ribs or projections 8 for increasing its strength. A plate 9 can be affixed outside of the door for securing the lock against destruction of its cylinder, and plate 9 secures also the heads 5 of the bolts 4.

What is claimed:

1. A plate for preventing separation of a lock from a surface of a side of a door to which the lock is independently mounted, the plate being independent from the lock and the lock being mountable to the door without the plate, the plate including a recessed portion and at least two flange portions adjacent the recessed portion, each flange portion having at least one hole therethrough, the recessed portion and the flange portions being configured so that the flange portions seat on the door surface adjacent sides of the lock with the recessed portion covering at least part of the lock, the plate being mountable to the door by fasteners passed through the holes in the flange portions.

2. The plate according to claim 1 wherein an opening is provided in the recessed portion to provide access to a means for locking the lock.

3. A device for preventing separation of a lock from a surface of a first side of a door to which the lock is independently mounted, the device comprising first and second plates and a plurality of bolts mounting the plates to the door, each of the plates being independent from the lock and the lock being mountable to the door without the plates, the first plate including a recessed portion and at least two flange portions adjacent the recessed portion, each flange portion having at least one hole therethrough, the recessed portion and the flange portions being configured so that the flange portions seat on said door surface adjacent sides of the lock with the recessed portion covering at least part of the lock, the first plate being mounted to said door surface by bolts passing through the door from a side thereof opposite to said first side and passing through said holes in said flange portions, the second plate being mounted to a surface of said opposite door side by bolts passing through the door and positioned to cover the ends of the bolts mounting the first plate to the door.

* * * * *